US007185889B2

(12) United States Patent
VanZanten

(10) Patent No.: US 7,185,889 B2
(45) Date of Patent: Mar. 6, 2007

(54) CASINO TABLE WAGERING GAME AND METHOD THEREFOR

(76) Inventor: David S. VanZanten, 8709 Red Rio Dr., No. 103, Las Vegas, NV (US) 89128

( * ) Notice: Subject to any disclaimer, the term of this patent is extended or adjusted under 35 U.S.C. 154(b) by 123 days.

(21) Appl. No.: 10/947,123

(22) Filed: Sep. 22, 2004

(65) Prior Publication Data

US 2006/0061036 A1 Mar. 23, 2006

(51) Int. Cl.
*A63F 1/00* (2006.01)
*A63F 9/04* (2006.01)

(52) U.S. Cl. ..... 273/274; 273/292; 273/145 R; 273/146; 273/145 A; 273/145 C; 273/144 R

(58) Field of Classification Search ..... 273/274, 273/292, 145 R, 146, 144 R, 309, 145 A, 273/145 C See application file for complete search history.

(56) References Cited

U.S. PATENT DOCUMENTS

| | | | | |
|---|---|---|---|---|
| 4,469,329 | A * | 9/1984 | Guyer | 273/146 |
| 5,413,351 | A * | 5/1995 | Franklin | 273/274 |
| 5,573,248 | A * | 11/1996 | Parra et al. | 273/274 |
| 5,662,330 | A * | 9/1997 | Spears | 273/274 |
| 5,806,847 | A * | 9/1998 | White et al. | 273/309 |
| 6,007,065 | A * | 12/1999 | Ress | 273/146 |
| 6,062,563 | A * | 5/2000 | de Keller | 273/274 |
| 6,179,293 | B1 * | 1/2001 | Hedman | 273/292 |
| 6,234,482 | B1 * | 5/2001 | Henderson | 273/274 |
| 6,749,200 | B2 * | 6/2004 | Yurkins | 273/292 |
| 2005/0077681 | A1 * | 4/2005 | Kowalczyk | 273/302 |

FOREIGN PATENT DOCUMENTS

DE 3328600 A1 * 10/1984

OTHER PUBLICATIONS http://www.everything2.com/index.pl?node_id=1280398 "Perudo," Apr. 5, 2002.*

* cited by examiner

*Primary Examiner*—Benjamin Layno
(74) *Attorney, Agent, or Firm*—Jeffrey D. Moy; Harry M. Weiss; Weiss & Moy, P.C.

(57) ABSTRACT

A method of playing a wagering game where each player is dealt a plurality of playing pieces. Each player will review the playing pieces. A first player will make a call of a total quantity of a numeric suit on all playing pieces. Each successive player will make a next call of the total quantity of the numeric suit of all playing pieces unless another player challenges that the call is incorrect. For each successive call, the next call has to be one where either the quantity of the numeric suit increases, a value of the numeric suit increases and the quantity stays the same, or both the quantity and the numeric suit increases. After a challenge is made, each player will display the playing pieces. A winning player is decided by seeing if the total quantity of the numeric suit of all playing pieces by a last player to make a call is correct or if the player challenging is correct.

18 Claims, 2 Drawing Sheets

| | |
|---|---|
| WILD/NATURAL FULL HOUSE | $10 PAYS 40 |
| NATURAL FULL HOUSE | 10 - 200 |
| WILD/NATURAL STRAIGHT | 10 - 50 |
| NATURAL STRAIGHT | 10 - 200 |
| WILD/NATURAL 5-of-a-kind | 10 - 500 |
| NATURAL 5-of-a-kind | 10 - 10,000 |

CASINO TABLE WAGERING GAME AND METHOD THEREFOR

BACKGROUND OF THE INVENTION

1. Field of the Invention

This invention relates generally to a wagering game, and more specifically, to a table wagering game that may be played with dice, a deck of playing cards or by video machine technology wherein the game is determined by the total number of like elements rolled/drawn.

2. Description of the Prior Art

Presently, there are many different wagering games used in gambling establishments. The problem with many of these games are that they are difficult to understand. This relates to not only how to play but the strategy involved in playing. Thus, many people who would normally like to play and gamble, end up not playing.

Most people like to play wagering games that are fairly simple to understand and play. Ideally, a wagering game should have different wagering options for the players, yet be able to be played rapidly to a wager resolving outcome. Wagering games, particularly those intended primarily for play in gambling establishments, should provide players with a sense of participation and control, the opportunity to make decisions, and reasonable odds of winning even though the odds will favor the gambling establishment.

Another problem with current table games is that the players only challenge the house/casino. Or, as in the case of most poker type games, the players only challenge each other. In order to increase the excitement and the payout, a wagering game where the players challenge not only each other but the house as well will double the excitement and increase the payoffs.

Therefore, a need existed to provide an improved wagering game. The improved wagering game must overcome the problems associated with prior art wagering games. The improved wagering game should be easy to play and understand. The improved wagering game should provide players with a sense of participation and control, the opportunity to make decisions, and reasonable odds of winning. The improved wagering game must also increase the excitement and the payout by having the players challenge not only each other but the house as well.

SUMMARY OF THE INVENTION

In accordance with one embodiment of the present invention, it is an object of the present invention to provide an improved wagering game.

It is another object of the present invention to provide an improved wagering game that overcome the problems associated with prior art wagering games.

It is still another object of the present invention to provide an improved wagering game that is easy to play and understand.

It is still another object of the present invention to provide an improved wagering game that provides players with a sense of participation and control, the opportunity to make decisions, and reasonable odds of winning.

It is yet another object of the present invention to provide an improved wagering game that increases the excitement and the payout by having the players challenge not only each other but the house as well.

BRIEF DESCRIPTION OF THE EMBODIMENTS

In accordance with one embodiment of the present invention, a method of playing a wagering game is disclosed. The method comprising: dealing each player a plurality of playing pieces; reviewing of the playing pieces by each player; making a call of a total quantity of a numeric suit on all playing pieces by a first player; continuously making a next call of the total quantity of the numeric suit of all playing pieces by a next player unless another player challenges that the call is incorrect, wherein the next call is one of the quantity of the numeric suit increases, a value of the numeric suit increases and the quantity stays the same, or both the quantity and the numeric suit increases; displaying playing pieces by each player after a challenge; and deciding a winning player by seeing if the total quantity of the numeric suit of all playing pieces by a last player to make a call is correct or if the player challenging is correct.

In accordance with another embodiment of the present invention, a method of playing a wagering game is disclosed. The method comprising: entering a playing wager by each player, wherein the playing wagers comprises: an ante; an in-order challenge wager; and an out-of-order challenge wager; dealing each player and a house player a plurality of playing pieces; reviewing of the playing pieces by each player; making a call of a total quantity of a numeric suit on all playing pieces by a first player; continuously making a next call of the total quantity of the numeric suit of all playing pieces by a next player unless another player challenges that the call is incorrect, wherein the next call is one of the quantity of the numeric suit increases, a value of the numeric suit increases and the quantity stays the same, or both the quantity and the numeric suit increases; displaying playing pieces by each player and the house player after a challenge; deciding a winning player by seeing if the total quantity of the numeric suit of all playing pieces by a last player to make a call is correct or if the player challenging is correct; and counting total point value of all playing pieces of the house player, wherein the house player is a partial winner if the total point value is equal to or exceeds a predetermined number.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
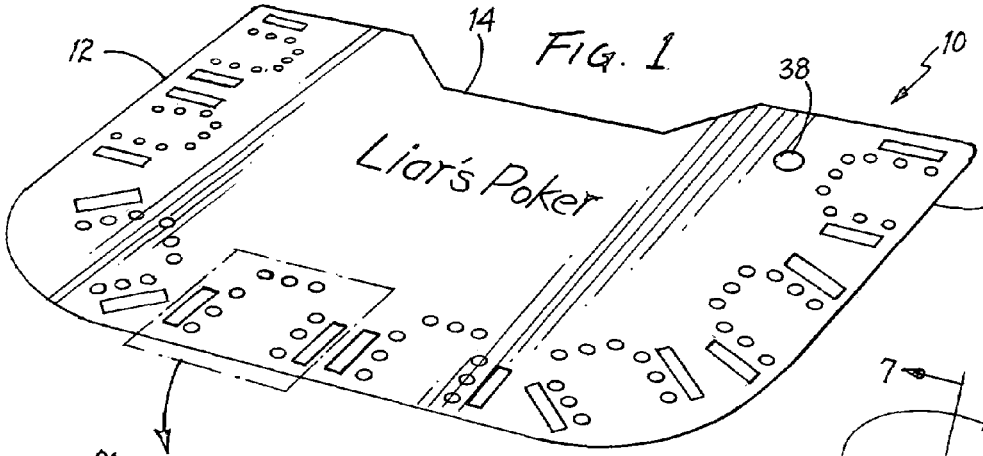
FIG. 1 is a simplified view of a table used in playing the wagering game of the present invention.
Figure 2:
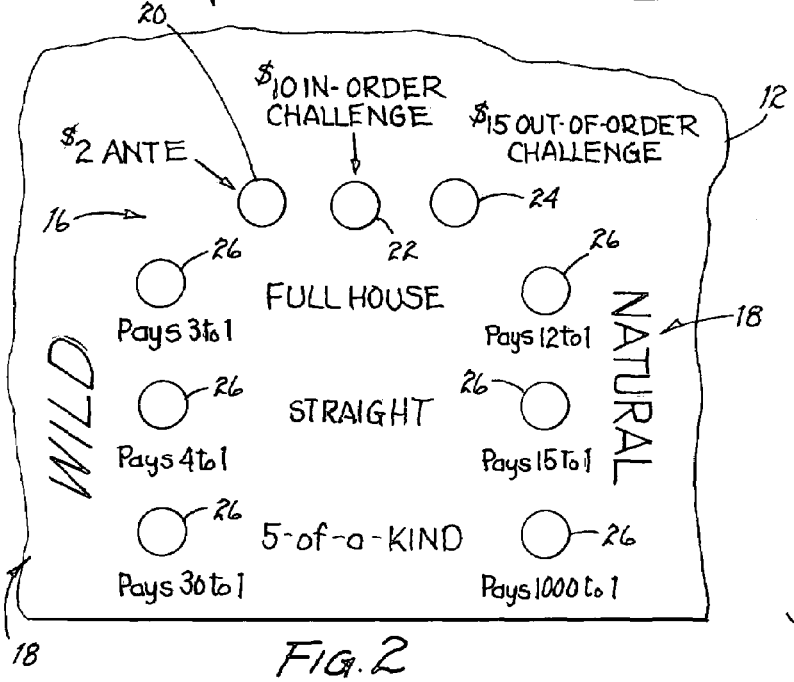
FIG. 2 is a close-up view of an individual station on the table depicted in FIG. 1.
Figure 3:
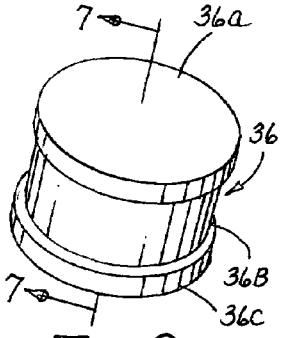
FIG. 3 is an elevated perspective view of a dice shaker used in one embodiment of the wagering game of the present invention.

Referring now to the Figures, the wagering game of the present invention will be disclosed. The wagering game is played on a table 10. The table 10 will have a plurality of player positions 12 and one house position 14. In front of each player position 12 will be a plurality of wagering options. The wagering options include playing options 16 and side wager options 18. The playing options include an ante wager location 20, an in-order wager location 22, and an out-of-order wager location 24. While specific monetary amounts are displayed in FIG. 1, other monetary amounts may be used without departing from the spirit and scope of the present invention. The specific monetary amounts may be set by the house.

In order to play, a player must place a minimum ante wager. The ante wager is placed on the ante wager location 20 on the playing surface 10. The ante wager can be any amount of money. In general, the minimum ante wager is determined by the gambling establishment. Each player must also place the designated wagers in the in-order wager location 22 and the out-of-order wager location 24. Again, in-order wager and the out-of-order wager may be any amount of money and is generally determined by the gambling establishment.

Each player may also place side bets on the side wager options 18. However, placing a side wager is not mandatory in order to play. The side wager options 18 include a plurality of different wager locations 26. Each location 26 will list the payout odds associated with the specific location 26. Each location 26 relates to different poker hands obtained either naturally or with a wildcard.

Figure 5B:
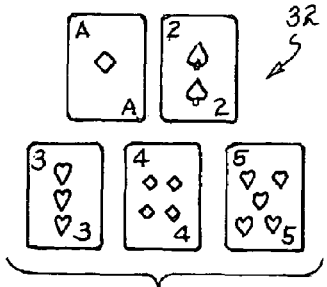
FIG. 5B is a front view of a plurality of cards from a standard card set used in another embodiment of the wagering game of the present invention.
Figure 4:
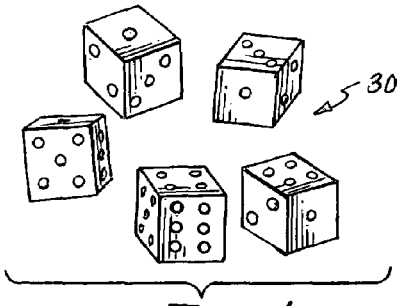
FIG. 4 is an elevated perspective view of a set of dice used in one embodiment of the wagering game of the present invention.

The wagering game is played with a plurality of dice 30 as shown in FIG. 4. However, other items may be used instead of the dice 30. For example, a standard deck of playing cards 32 (FIG. 5B) may be used. If a standard deck of cards 32 is used, in general, the cards with values of only 1 through 5 should be used. Any number of decks 32 of playing cards may be used. Alternatively, a custom deck of cards 34 (FIG. 5A) may be used. Each card of the custom deck 34 would show a certain dice position on one side.

Figure 5A:
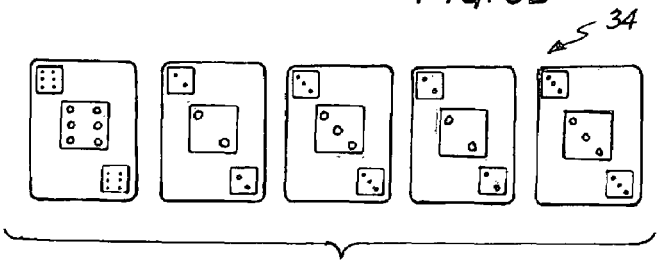
FIG. 5A is a front view of a plurality of cards from a custom card set used in another embodiment of the wagering game of the present invention.
Figure 6:
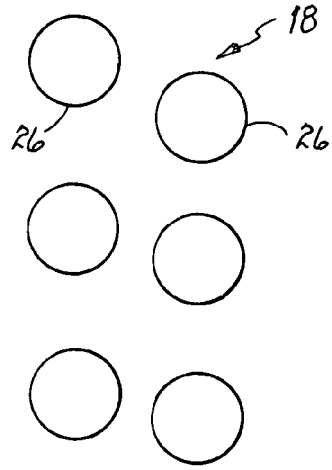
FIG. 6 shows an alternative embodiment of an individual station on the table depicted in FIG. 1.
Figure 7:
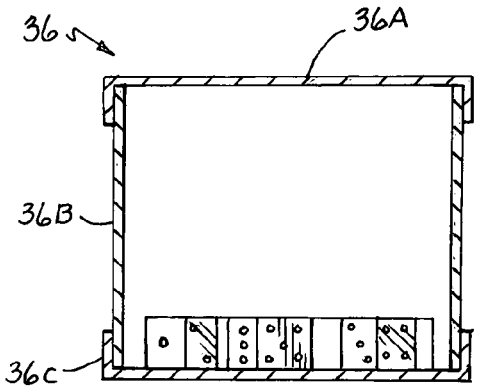
FIG. 7 is a cross-sectional view of the dice shaker of FIG. 3 taken along lines 7—7.
Figure 8:
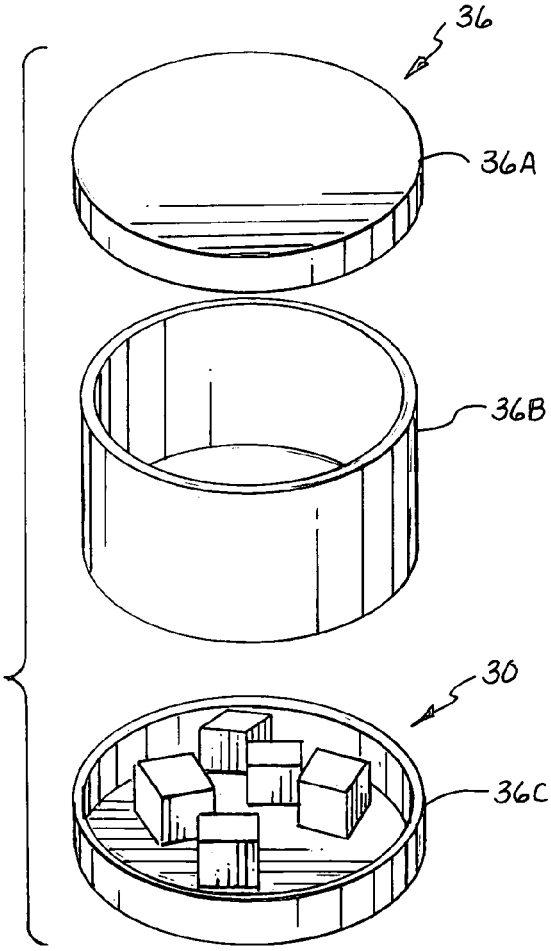
FIG. 8 is an exploded view of the dice shaker depicted in FIG. 3.

Once each player has placed the minimum ante wager in the ante wager location 20 and the designated wagers in the in-order wager location 22 and the out-of-order wager location 24, and any desired side bets, each player and the dealer will place the plurality of dice 30 into a dice shaker 36. Alternatively, the dealer may distribute a designated amount of cards from the standard deck of playing cards 32 (FIG. 5B) or the custom deck of cards 34 (FIG. 5A) to each player as well as to himself. While five dice 30 and cards are shown in the Figures, different amounts of dice 30 and cards maybe used without departing from the spirit and scope of the present invention. The method of playing the game will be further described with using the plurality of dice 30. However, as stated above, the dealer may distribute a designated amount of cards from the standard deck of playing cards 32 (FIG. 5B) or the custom deck of cards 34 (FIG. 5A).

The plurality of dice 30 are to be shaken in the dice shaker 36. Each player must shake the dice 30 in the dice shaker 36 a predetermined amount of times in order to ensure that the dice 30 are properly shakes. When finished, each player will place his/her dice shaker 36 on the take 10. The dice shaker 36 is designed so that the body section 36B is slightly tapered. Thus the top end of the body section 36B is slightly smaller than the bottom end. This will ensure that all the dice 30 will fall and lay flat on the bottom lid 36C.

Each player will then take a look at his/her dice 30 by lifting the top lid 36A of the dice shaker 36. Each player should try not to show his/her dice 30 to the other players. A marker 38 is placed next to the first player. Similar to poker, the beginning player revolves clockwise from the dealer/house. The marker indicates the current player to call the dice.

The current player will make a call as to the total combination of a particular number on the dice he/she believes are contained within his cup in combination with the dice of all other players. The dealer's dice are not included in this sum. So, the player's call should include his speculation as to the total combination of all players dice. For example, if three players are playing, the first player may call 6 fives. This tells the other players that his dice, along with the other two players dice, meet or exceed a total of 6 fives. The player may have no fives or he may have many fives, so bluffing may be involved.

After the first player announces a number combination, one of three things happens. First, the next player can either up the existing bet, and say, for example, 7 fives (or 8 fives for that matter), or he can say 6 sixes. So, either the quantity of the predicted total dice must increase, the value of the numeric suit must increase and quantity of the predicted value stays the same, or both the quantity and value must increase. Second, the next player can challenge the first player if he/she does not believe the first player. The second player can challenge. The second player can challenge by ringing a buzzer, opening his/her dice shaker 36, or any other like manner. Third, a different player can challenge the first player if he/she does not believe the first player. This is called an out-of-order challenge.

Assuming the second player simply ups the value, for example states 7 fives, then the game keeps progressing clockwise until someone challenges. Once a person challenges, all other players are then requested by the dealer to open up their dice shaker 36 to reveal their rolls. This is done by raising the body section 36B of the dice shaker 36 to show the dice 30 in the bottom lid 36C.

The challengee must have at least the quantity he last called. If he has less, he loses his in-order challenge bet if the challenger challenged in order, or he loses his out-of-order challenge bet if the challenger challenged out-of-order.

The game is further entertaining because the winner, either the challengee or challenger, normally wins all of the ante and the loser's in-order challenge money, if the challenge was started by the player to the last caller's left, or wins the ante and the loser's out-of-order challenge money, if the challenge was started by any other player than the player to the last caller's left. However, the house can 'trump' the challenge if the dealer's dice total is equal to or greater than a predetermined sum or if the dealer rolls a desired hand. For example, for five dice, the house may pick a sum of 20. Thus, if the total value of all five dice of the dealer is equal to or greater than 20, the house gets the challenge money, but the winner still gets the ante money. Alternatively, the house may chose that a dealer will "trump" the challenge if the dealer rolls a predetermined hand like a pair of "snake eyes" or another combination. Again, if this happens the house gets the challenge money, but the winner gets the ante money.

The game can be played with a wildcard. For example, the number "one" may be designated as a wildcard. Thus, any player who has rolled a "one" on one or more of his dice, can use those dice as a wildcard (i.e., as any number). The number to be used as a wildcard is generally to be chosen by the house.

As stated above, players also have the opportunity to make side bets. Side bets are currently natural or wild 5-of-a-kind (5 dice all the same for natural five-of-a-kind; 5 dice the same if one dice are wild for wild 5-of-a-kind (example: 3 threes and 2 ones is a wild five-of-a-kind), natural or wild straight, and natural or wild full house. Other types of "poker" type hands may also be used as side bets without departing from the spirit and scope of the present invention.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of playing a wagering game comprising:

entering an ante by each player;

entering an in-order challenge wager by each player, the in-order challenge wager allowing a directly next player to challenge a current player if the directly next player does not believe a call by the current player;

entering an out-of-order challenge wager by each player, the out-of-order challenge wager allowing any player other than the directly next player to challenge the current player if the player other than the directly next player does not believe a call by the current player;

dealing each player a plurality of playing pieces;

reviewing of the playing pieces by each player;

making a call of a total quantity of a numeric suit on all playing pieces by a first player;

continuously making a next call of the total quantity of the numeric suit of all playing pieces by a next player unless another player challenges that the call is incorrect, wherein the next call is one of the quantity of the numeric suit increases, a value of the numeric suit increases and the quantity stays the same, or both the quantity and the numeric suit increases;

displaying playing pieces by each player after a challenge; and deciding a winning player by seeing if the total quantity of the numeric suit of all playing pieces by a last player to make a call is correct or if the player challenging is correct.

2. A method of playing a wagering game in accordance with claim 1 further comprising:

dealing house player a plurality of playing pieces;

displaying playing pieces by the house player after a challenge; and counting total point value of all playing pieces of the house player, wherein the house player is a partial winner if the total point value is equal to or exceeds a predetermined number.

3. A method of playing a wagering game in accordance with claim 2 wherein the winning player receives all antes entered and the house player gets one of the in-order challenge wager or the out-of-order challenge wager if the house player is a partial winner.

4. A method of playing a wagering game in accordance with claim 1 further comprising:

dealing house player a plurality of playing pieces;

displaying playing pieces by the house player after a challenge;

reviewing playing pieces of the house player, wherein the house player is a partial winner if playing pieces form a predetermined hand.

5. A method of playing a wagering game in accordance with claim 1 further comprising picking a designated numeric suit to be a wildcard before dealing each player a plurality of playing pieces.

6. A method of playing a wagering game in accordance with claim 1 further comprising entering a side wager by a desired player.

7. A method of playing a wagering game in accordance with claim 6 wherein the side wager is a particular poker hand that the player obtains.

8. A method of playing a wagering game in accordance with claim 1 wherein the playing pieces are a plurality of dice.

9. A method of playing a wagering game in accordance with claim 8 further comprising providing a dice shaker.

10. A method of playing a wagering game in accordance with claim 9 wherein providing a dice shaker further comprises:

providing a body section wherein the body section is tapered so that a top section is narrower than a bottom section;

providing a removable top cover; and providing a removable bottom cover.

11. A method of playing a wagering game in accordance with claim 1 wherein the playing pieces are a plurality of cards.

12. A method of playing a wagering game in accordance with claim 1 wherein the winning player receives all antes entered and one of the in-order challenge wager or the out-of-order challenge wager.

13. A method of playing a wagering game comprising:

entering a playing wager by each player, wherein the playing wagers comprises:

an ante by each player;

an in-order challenge wager by each player, the in-order challenge wager allowing a directly next player to challenge a current player if the directly next player does not believe a call by the current player; and an out-of-order challenge wager by each player, the out-of-order challenge wager allowing any player other than the directly next player to challenge the current player if the player other than the directly next player does not believe a call by the current player;

dealing each player and a house player a plurality of playing pieces;

reviewing of the playing pieces by each player;

making a call of a total quantity of a numeric suit on all playing pieces by a first player;

continuously making a next call of the total quantity of the numeric suit of all playing pieces by a next player unless another player challenges that the call is incorrect, wherein the next call is one of the quantity of the numeric suit increases, a value of the numeric suit increases and the quantity stays the same, or both the quantity and the numeric suit increases;

displaying playing pieces by each player and the house player after a challenge;

deciding a winning player by seeing if the total quantity of the numeric suit of all playing pieces by a last player to make a call is correct or if the player challenging is correct; and counting total point value of all playing pieces of the house player, wherein the house player is a partial winner if the total point value is equal to or exceeds a predetermined number.

14. A method of playing a wagering game in accordance with claim 13 further comprising picking a designated numeric suit to be a wildcard before dealing each player and the house player a plurality of playing pieces.

15. A method of playing a wagering game in accordance with claim 13 further comprising entering a side wager by a desired player wherein the side wager is a particular poker hand that the player obtains.

16. A method of playing a wagering game in accordance with claim 13 wherein the playing pieces are a plurality of dice.

17. A method of playing a wagering game in accordance with claim 13 wherein the winning player receives all antes entered and one of the in-order challenge wager or the out-of-order challenge wager.

18. A method of playing a wagering game in accordance with claim 13 wherein the winning player receives all antes entered and the house player gets one of the in-order challenge wager or the out-of-order challenge wager if the house player is a partial winner.

* * * * *